US006634888B2

(12) United States Patent
Villain

(10) Patent No.: US 6,634,888 B2
(45) Date of Patent: Oct. 21, 2003

(54) ELECTRICAL CONNECTION DEVICE

(75) Inventor: Jean-Christophe Villain, Colombes (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/072,948

(22) Filed: Feb. 12, 2002

(65) Prior Publication Data

US 2002/0127891 A1 Sep. 12, 2002

(30) Foreign Application Priority Data

Mar. 8, 2001 (FR) ..... 01 03152

(51) Int. Cl.[7] ..... H01R 39/00
(52) U.S. Cl. ..... 439/22; 439/21; 439/76.1
(58) Field of Search ..... 439/22, 21, 27, 439/76.1, 660, 13, 18, 20, 736

(56) References Cited

U.S. PATENT DOCUMENTS 4,590,337 A 5/1986 Engelmore
4,932,882 A * 6/1990 Kang ..... 439/22
5,082,448 A * 1/1992 Kang ..... 439/22
5,352,122 A 10/1994 Speyer et al.
5,551,882 A * 9/1996 Whiteman et al. ..... 439/21
5,704,792 A 1/1998 Sobhani

FOREIGN PATENT DOCUMENTS

FR 1 414 008 1/1965
GB 2 280 715 A 4/1995

* cited by examiner

*Primary Examiner*—Tho D. Ta
(74) *Attorney, Agent, or Firm*—Sughrue Mion, PLLC

(57) ABSTRACT

The invention relates in particular to a fixed electrical connection member for use on an electronic device to connect an electrical conductor of the device to a mobile electrical connection member outside the electronic device, wherein the fixed electrical connection member includes, on a front face adapted to be disposed on the outside of the electronic device, a conductive circular track connected to said electrical conductor of the electronic device, inside the electronic device, on a rear face, by an electrical conductor disposed in a bore passing through the fixed member.

22 Claims, 4 Drawing Sheets

ELECTRICAL CONNECTION DEVICE

The invention relates to electrical connection devices for electrically connecting two electrical or electronic devices, for example a mobile telephone and a battery charger or an earpiece.

BACKGROUND OF THE INVENTION

For this kind of electrical connection, it is known in the art to use devices known as "jacks" which take the form of a receptacle, generally of circular section, into which a circular section plug is inserted. The receptacle is carried by the device and the plug terminates a multiconductor cable.

The receptacle and the plug each have the same number of conductive sections along their length, separated by insulative sections, the number of conductive sections depending on the number of conductors to be connected; corresponding conductive sections of the receptacle and the plug cooperate to make the electrical contact between them.

As electrical connection devices, jacks and the associated plugs have the following drawbacks:

- a limited number of conductors can be interconnected,
- they have large overall length, which increases with the number of conductors to be connected,
- they break easily if the plug is pulled out roughly, even if it is elbow-shaped,
- the opening of the receptacle and the receptacle itself can be soiled, for example by dust or by grains of sand, which leads to poor electrical contact, which can in turn lead to a fault caused by damage to the conductive sections,
- the receptacle can be filled with water, which can also lead to poor electrical contact and a possible fault, and
- the cables that can be connected to the devices are distinguished from each other by the diameter of the plug, and therefore of the receptacle, and a plug can be forced into a receptacle of slightly smaller diameter, causing damage that can lead to a fault.

OBJECTS AND SUMMARY OF THE INVENTION

An object of the present invention is therefore to provide an electrical connection device, for making an electrical connection between a cable and an electrical/electronic device, that does not have the drawbacks of prior art electrical connection devices, in particular the drawbacks of the jacks and the associated plugs referred to above.

The above object is achieved by an electrical connection device in two parts, one of which has conductive circular tracks that are electrically connected to conductors to be connected and the other of which has spring contacts each of which cooperates with a conductive circular track and is electrically connected to conductors to be connected; the two parts of the electrical connection device are assembled with an elastic clipping action that maintains a pressure between each conductive circular track and the corresponding spring contact.

The invention relates more particularly to a fixed electrical connection member for use on an electronic device to connect at least one electrical conductor of the electronic device to a mobile electrical connection member outside the electronic device, which fixed electrical connection member includes, on a front face adapted to be on the outside of the electronic device, a conductive circular track connected to said electrical conductor of the electronic device, inside the electronic device, on a rear face, by an electrical conductor disposed in a bore passing through the fixed member.

According to the invention, the electrical conductor passing through the fixed member is electrically connected to a spring contact adapted to cooperate with a fixed electrical terminal of the electronic device including said electrical conductor of the electronic device.

The spring contact of the fixed member has a mobile first end adapted to cooperate with said fixed terminal of the electronic device and a fixed second end fastened to the fixed member.

The fixed member further includes an electrical conductor on its outside surface for electrically connecting a circular portion of the front face to the rear face of the fixed member.

The electrical conductor on the outside surface is connected to a spring contact on the rear face of said fixed member.

The electrical conductor on the outside surface is a conductive layer deposited on all or part of said outside surface.

If there are two or more electrical conductors on the outside surface of the fixed member, the adjacent conductive layers are insulated from each other by a gap with no conductive deposit.

The front face of the fixed member includes assembly means, such as a groove, adapted to cooperate with the mobile electrical connection member.

The fixed electrical connection member further includes mounting means for removably fixing it to the electronic device, and holding means fastened to the electronic device and adapted to cooperate with the mounting means to fit and retain said fixed member.

The mobile electrical connection member adapted to cooperate with the fixed electrical connection member includes:

- a spring contact adapted to cooperate with a circular track of the fixed member, said spring contact having a mobile first end adapted to contact said circular track and a fixed second end adapted to be connected to an electrical conductor, and
- mounting means for mounting said mobile member on the peripheral part of the front face of the fixed member to connect said spring contact to said circular track.

The mounting means include an elastic ring adapted to clip elastically into a groove on the front face of the fixed member.

The elastic ring incorporates longitudinal slots to increase its elasticity.

The elastic ring is made of an insulative material or a conductive material and the conductive material cooperates with an electrical conductor on the outside surface of said fixed member, in particular when said conductors take the form of conductive layers covering all or part of the outside surface of the fixed member.

The invention also provides an electrical connection device including a fixed member and a mobile member as defined hereinabove and the mobile member clips onto the front face of the fixed member.

The invention further provides an electronic device incorporating a fixed member as defined hereinabove.

BRIEF DESCRIPTION OF THE DRAWINGS

Other features and advantages of the present invention will become apparent on reading the following description of one particular embodiment, said description being given with reference to the accompanying drawings, in which.

MORE DETAILED DESCRIPTION

Figure 1:
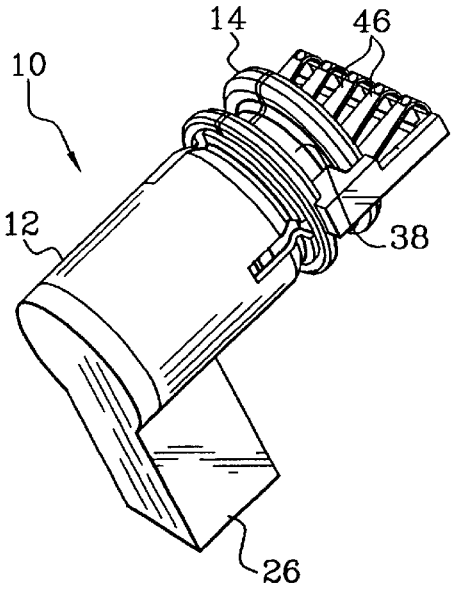
FIG. 1 is a perspective view of an electrical connection device according to the invention.
Figure 3:
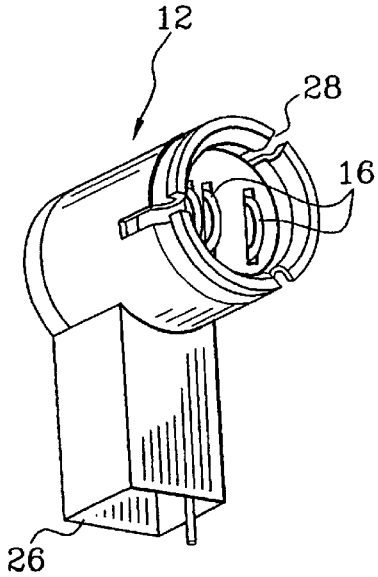
FIG. 3 is a perspective view of a portion of the electrical connection device that includes spring contacts.
Figure 2:
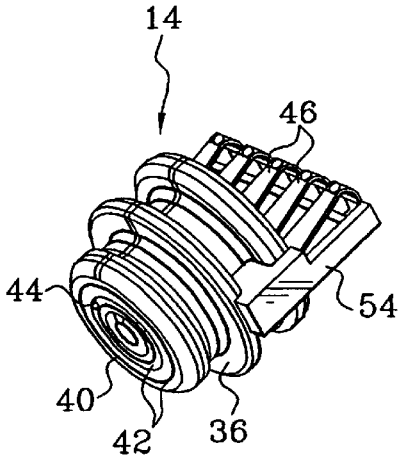
FIG. 2 is a perspective view of a portion of the electrical connection device that includes conductive circular tracks.
Figure 5:
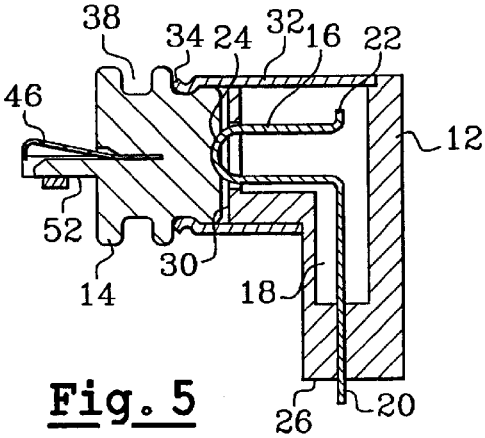
FIG. 5 is a view in section taken along the line V—V in FIG. 4.
Figure 4:
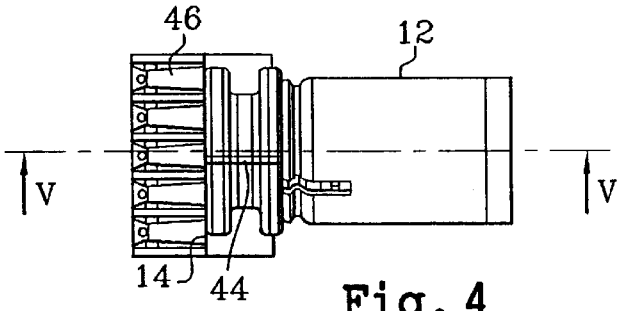
FIG. 4 is a top view of the electrical connection device shown in FIG. 1.
Figure 7:
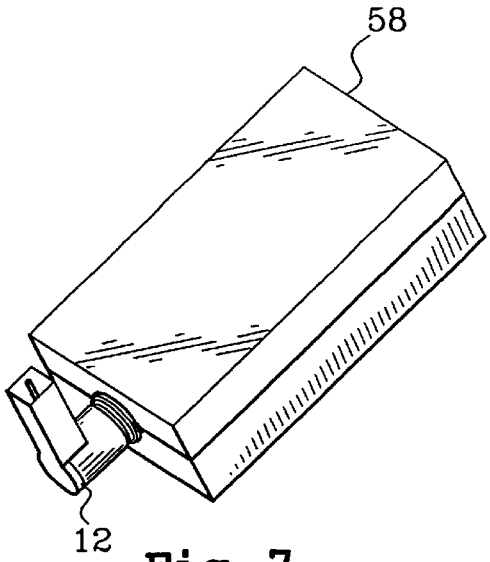
FIG. 7 is a view of the housing from FIG. 6 when closed.
Figure 6:
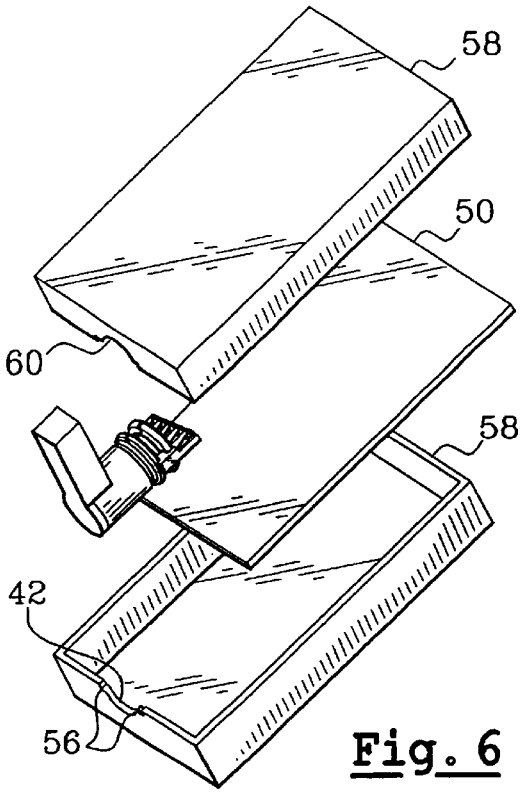
FIG. 6 is an exploded perspective view showing the arrangement of the electrical connection device with a housing containing the electronic circuits.
Figure 9:
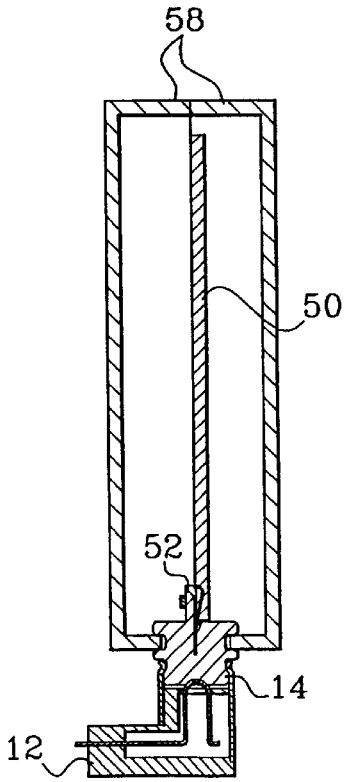
FIG. 9 is a view in section taken along the line IX—IX in the FIG. 8.
Figure 8:
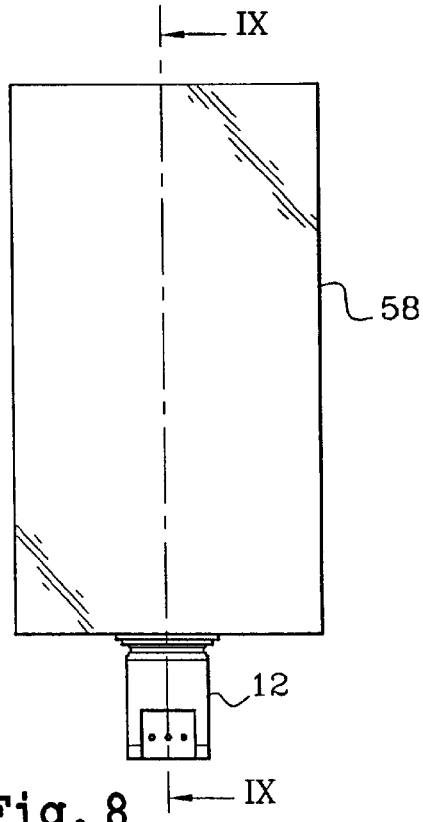
FIG. 8 is a top view of the housing from FIG. 7.
Figure 10:
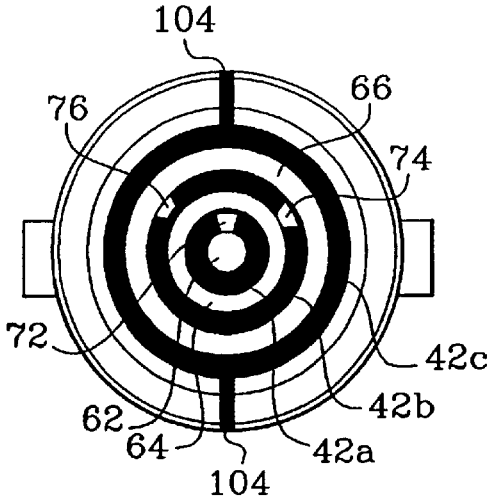
FIG. 10 is a front view of the fixed member.
Figure 11:
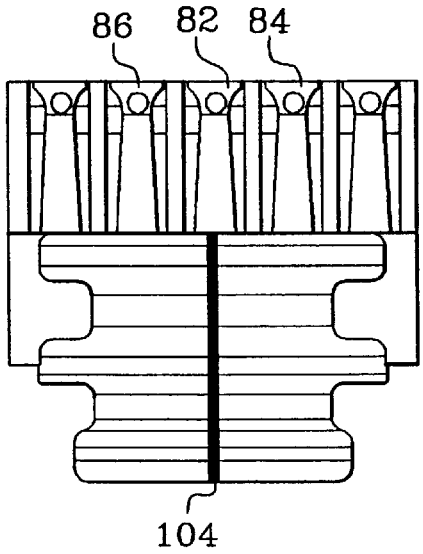
FIG. 11 is a top view of the fixed member.
Figure 12:
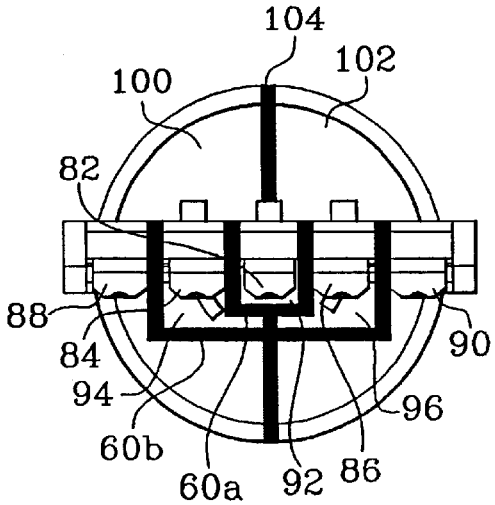
FIG. 12 is a rear view of the fixed member.
Figure 13:
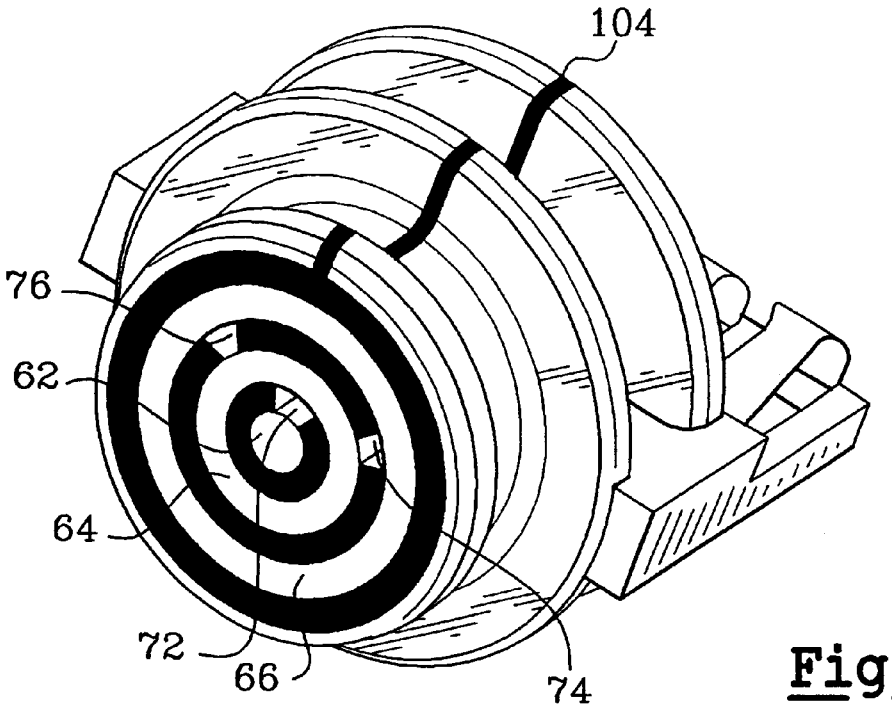
FIG. 13 is a front perspective view of the fixed member.
Figure 14:
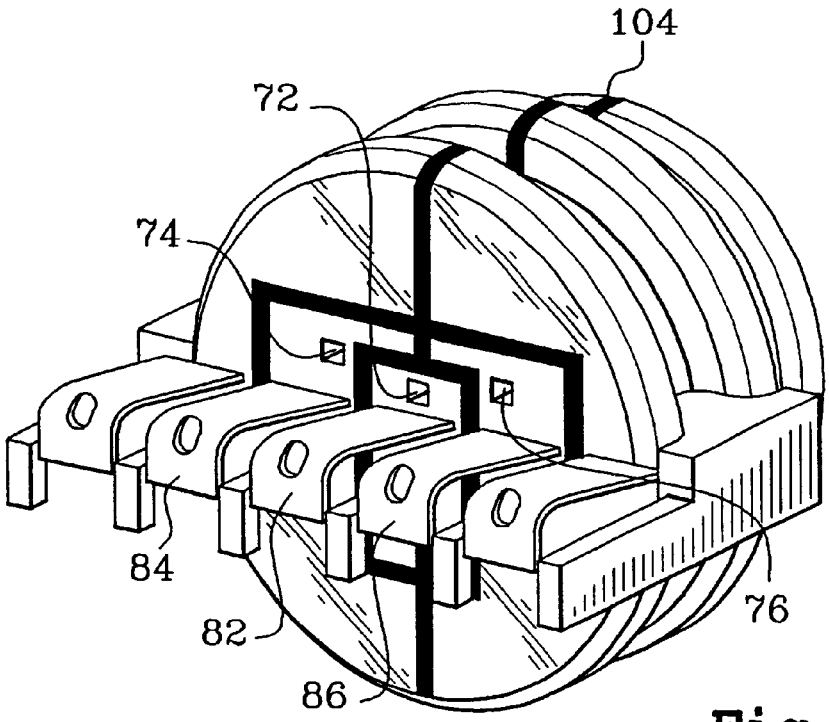
FIG. 14 is a rear perspective view of the fixed member.

An electrical connection device 10 in accordance with the invention has two separate parts or members 12 and 14 which can be assembled together, for example elastically clipped together.

The part 12, which is connected to a cable with n conductors (not shown), includes n spring contacts 16 which are accommodated in an elbow-shaped or straight plug 18. The plug 18 is made of an insulative material, for example a rigid plastics material. One end 20 of each electrical contact 18 exits from one end 26 of the plug and is adapted to be connected to one conductor of the cable; the other end 22 is curved into a U-shape to form a spring contact 24 that emerges from an end wall 30 at the other end 28 of the plug.

The end 28 of the plug extends beyond the end wall 30, and the contacts 24, in the form of a circular section ring 32 with an elastic end 34 that clips into a circular groove 36 on the part 14.

The ring 32 is preferably made of an electrically conductive metal, and can have three slots 60 on its outside periphery to improve its elasticity to facilitate clipping it to the part 14. The fact that the ring 32 is conductive is exploited to detect when an electrical connection is made between the two parts of the connection device.

However, in some applications, the ring 32 can be made of an insulative material, like the plug 18, in which case it consists of an integral part of the plug which features the slots 60 to improve its elasticity to facilitate clipping.

The part 14, which is adapted to be connected to electronic circuits of the device to be connected to the cable, is of generally circular cylindrical shape with circular grooves 36 and 38.

At the end with the groove 36, the part 14 has a circular surface 40 which includes n=3 conductive circular tracks 62, 64 and 66 adapted to cooperate through sliding contact with the portions 24 of the contacts 16 of the part 12 after they are clipped together.

Each circular track 62, 64 and 66 is associated with a respective bore 72, 74 and 76 providing a passage for a connecting conductor between a track and one of three output electrical contacts 82, 84 and 86 adapted to be connected to the electronic circuits.

The connecting conductor between the circular track 62, 64 or 66 and the corresponding contact 82, 84 or 86 takes the form of a conductive layer lining the walls of the corresponding bore, for example. Each bore opens at one end onto a conductive circular track and at the other end onto a conductive layer, namely the layer 92 for the bore 72, the layer 94 for the bore 74 or the layer 96 for the bore 76.

Each conductive circular track is insulated from an adjacent circular track by a circular insulative area 42*a*, 42*b*, 42*c* defined by the absence of the conductive deposit. The conductive layers 92, 94 and 96 are similarly separated from each other by insulative areas 60.

Each of the other two electrical contacts 88 and 90 adapted to be connected to the electronic circuits and disposed on either side of the central contacts 82, 84 and 86 is electrically connected to a respective conductive layer 100 and 102 covering the outside surface of the part 14, including the grooves 34 and 38. The conductive layers 100 and 102 are electrically insulated from each other by an area 104 with no conductive deposit; said area 104 limits each layer 100 and 102 to one half of the outside surface, terminating, on one side, at the larger diameter insulative circular area 42*c* and, on the other side, at the insulative areas 60*b* and 60*a*.

The conductive areas 100 and 102 are in contact with areas of the ring 32 when the two parts 12 and 14 are clipped together, with the result that the conductive areas 100 and 102, and therefore the contacts 88 and 90, are at the same potential, regardless of the relative position of the parts 12 and 14. This makes it possible to detect that the parts 12 and 14 are connected together.

The part 14, in particular each of its electrical contacts 82 to 90, is adapted to cooperate with the support 50 of the electronic circuits, to be more precise with the output terminals of the electronic circuits. To this end, the contacts 82 to 90 are disposed on a laterally extended plate 52 parallel to the support 50, its lateral extensions 54 interengaging in cut-outs 56 in the walls of the housing 58 containing the electronic circuits on the support 50.

In addition, the part 14 is fixed to the housing by a cut-out 42 cooperating with the grooves 38.

The connection device according to the invention has the following advantages:

- the part 14 of the connection device, which is fixed to the housing 58, is in elastic contact with the support 50 thanks to the contacts 82 to 90, which reduces the probability of damage to the electrical connections to the support 50 if the housing is dropped,
- there is no possibility of forcibly connecting two parts 12 and 14 that are not designed to be interconnected, because their diameters are different, depending on the type of cable to be connected,
- if the plug is pulled out roughly, the part 12 separates easily, without damaging the part 14 and consequently without damaging the support 50, because of the elasticity of the ring 32 and the elasticity of the connection to the support 50,
- wear of the contacts, tracks 62, 64 and 66 and contacts 24 by successive connection and disconnection is minimized because there is no sliding of the two ends relative to each other, the probability of soiling of the contacts is reduced because there is no receptacle and, in the event of soiling, it is easy to clean the contacts, the possibility of ingress of water is limited because there is no receptacle, the number of conductors to be interconnected can be increased by increasing the number and the diameter of the conductive tracks, and for the same number of conductors to be connected, the dimensions are at least halved compared to a jack and the associated plug.

What is claimed is:

1. An electrical connection device for use on an electronic device, the electrical connection device comprising a fixed member to connect at least one electrical conductor of the electronic device to a mobile member outside the electronic device, wherein the fixed member includes, on a front face adapted to be disposed on an outside of the electronic device, a conductive circular track connected to said at least one electrical conductor of the electronic device that is inside the electronic device, on a rear face of the fixed member, by an electrical conductor disposed in a bore passing through the fixed member, the mobile member clipping onto the front face of the fixed member; and wherein the front face of the fixed member is an outwardly exposed face of the fixed member upon disconnection of the mobile member from the fixed member; and wherein the mobile member clips onto to the front face of the fixed member to form a temporary connection between the fixed member and the mobile member that is configured for frequent manual disconnection and reconnection of the fixed member and the mobile member without the use of a tool.

2. An electrical connection device according to claim 1, wherein the front face of the fixed member includes assembly means for coupling the fixed member to the mobile member.

3. An electrical connection device according to claim 1, wherein the fixed member further includes: mounting means for removably fixing it to the electronic device, and holding means fastened to the electronic device and cooperating with the mounting means for fitting and retaining said fixed member.

4. An electrical connection device according to claim 1, wherein said electrical conductor passing through the fixed member is electrically connected to a spring contact adapted to cooperate with a fixed electrical terminal of the electronic device including said electrical conductor of the electronic device.

5. An electrical connection device according to claim 4, wherein said spring contact of the fixed member has a mobile first end adapted to cooperate with said fixed terminal of the electronic device and a fixed second end fastened to the fixed member.

6. An electrical connection device according to claim 1, wherein the mobile member includes: a spring contact adapted to cooperate with the circular track of the fixed member, said spring contact having a mobile first end adapted to contact said circular track and a fixed second end adapted to be connected to an electrical conductor of the mobile member, and mounting means for mounting said mobile member on a peripheral part of the front face of the fixed member to connect said spring contact to said circular track.

7. An electrical connection device according to claim 6, wherein the mounting means include an elastic ring adapted to clip into a groove on the front face of the fixed member.

8. An electrical connection device according to claim 7, wherein the elastic ring incorporates longitudinal slots to increase its elasticity.

9. An electrical connection device according to claim 7, wherein said elastic ring is made of an insulative material.

10. An electrical connection device for use on an electronic device, the electrical connection device comprising a fixed member to connect at least one electrical conductor of the electronic device to a mobile member outside the electronic device, wherein the fixed member includes, on a front face adapted to be disposed on an outside of the electronic device, a conductive circular track connected to said at least one electrical conductor of the electronic device that is inside the electronic device, on a rear face of the fixed member, by an electrical conductor disposed in a bore passing through the fixed member, the mobile member clipping onto the front face of the fixed member; and wherein the fixed member further includes an electrical conductor on the outside surface of said fixed member for electrically connecting a circular portion of the front face to the rear face of the fixed member.

11. An electrical connection device according to claim 10, wherein said electrical conductor on the outside surface is connected to a spring contact on the rear face of said fixed member.

12. An electrical connection device according to claim 10, wherein the mobile member includes:

a spring contact adapted to cooperate with a circular track of the fixed member, said spring contact having a mobile first end adapted to contact said circular track and a fixed second end adapted to be connected to an electrical conductor, and mounting means for mounting said mobile member on the peripheral part of the front face of the fixed member to connect said spring contact to said circular track, the mounting means including an elastic ring, made of a conductive material, adapted to clip into a groove on the front face of the fixed member and cooperating with an electrical conductor on the outside surface of said fixed member.

13. An electrical connection device according to claim 10, wherein said electrical conductor on the outside surface is a conductive layer deposited on all or part of said outside surface.

14. An electrical connection device according to claim 13, wherein, if there are two or more electrical conductors on the outside surface of the fixed member, the adjacent conductive layers are insulated from each other by a gap with no conductive deposit.

15. An electronic device incorporating: at least one electrical conductor intended to be connected to a mobile electrical connection member outside the electronic device; and a fixed electrical connection member to connect the electrical conductor to the mobile member, the fixed member including, on a front face adapted to be disposed on an outside of the electronic device, a conductive circular track connected to said electrical conductor of the electronic device that is inside the electronic device, on a rear face of the fixed member, by an electrical conductor disposed in a bore passing through the fixed member, the mobile member clipping onto the front face of the fixed member; and wherein the front face of the fixed member is an outwardly exposed face of the fixed member upon disconnection of the mobile member from the fixed member; and wherein the mobile member clips onto to the front face of the fixed member to form a temporary connection between the fixed member and the mobile member that is configured for frequent manual disconnection and reconnection of the fixed member and the mobile member without the use of a tool.

16. A connector, comprising:

a male connector member fixed to an electronic device;

a female connector member for connecting to and disconnecting from the male connector so as to electrically mate and demate with the male connector member, respectively;

wherein the male connector member comprises:

a front face having a conductive circular track that is outwardly exposed upon disconnecting the female connector from the male connector;

a rear face having a first conductive member electrically connected to the electronic device; and a bore having a second conductive member electrically connecting the conductive circular track to the first conductive member; and wherein the male connector member and the female connector member include a mechanical coupling to provide frequent manual connection and disconnection between the male connector member and the female connector member without the use of a tool.

17. The connector according to claim 16, wherein the female connector member comprises a third conductor that elastically abuts directly against the conduct track when the male connector member and the female connector member are mechanically connected.

18. The connector according to claim 16, wherein the electronic device is a mobile telephone and the female connector member electrically connects one of a battery charger and an ear piece to the mobile telephone.

19. The connector according to claim 16, wherein the male connector member includes an electrical conductor on an outside surface of the male connector member that electrically connects a circular portion of the front face of the male connector member to the rear face of the male connector member.

20. The connector according to claim 16, wherein the mechanical coupling is configured so that the male connector member and the female connector member are disconnected by pulling the male connector member and the female connector member apart and are connected by pushing the male connector member and the female connector member together.

21. The connector according to claim 20, wherein the mechanical coupling is a snap on coupling in which the female connector member includes an expandable ring, and the male connector member includes a mating circular groove.

22. A connector, comprising:

a male connector member fixed to an electronic device;

a female connector member for mating and demating with the male connector member;

wherein the mail connector member comprises:

a front face having a conductive circular track that is outwardly exposed upon disconnecting the female connector from the male connector;

a rear face having a first conductive member electrically connected to the electronic device; and a bore having a second conductive member electrically connecting the conductive circular track to the first conductive member; and the connector further comprising means for manually connecting and disconnecting the male connector member and the female connector member.

* * * * *